US007244073B2

(12) United States Patent
Trocino

(10) Patent No.: US 7,244,073 B2
(45) Date of Patent: Jul. 17, 2007

(54) TRAVEL TOOTHBRUSH ASSEMBLY

(76) Inventor: Richard B. Trocino, 516 Dawson Rd. #221, Austin, Travis County, TX (US) 78704

( * ) Notice: Subject to any disclaimer, the term of this patent is extended or adjusted under 35 U.S.C. 154(b) by 0 days.

(21) Appl. No.: 10/718,915

(22) Filed: Nov. 21, 2003

(65) Prior Publication Data

US 2004/0240928 A1 Dec. 2, 2004

Related U.S. Application Data

(60) Provisional application No. 60/320,224, filed on May 27, 2003.

(51) Int. Cl.
*A46B 11/04* (2006.01)
*B43K 5/06* (2006.01)

(52) U.S. Cl. ..... 401/277; 401/172; 401/174

(58) Field of Classification Search ..... 401/171–174, 401/270, 277, 282, 284
See application file for complete search history.

(56) References Cited

U.S. PATENT DOCUMENTS

| | | | | | |
|---|---|---|---|---|---|
| 499,612 | A | * | 6/1893 | Tower | 401/174 |
| 1,192,668 | A | * | 7/1916 | Miles | 401/154 |
| 1,362,937 | A | | 12/1920 | Grace | 401/174 |
| 1,486,394 | A | | 3/1924 | Smith | 401/291 |
| 1,498,439 | A | * | 6/1924 | Flom | 222/390 |
| 2,018,158 | A | | 10/1935 | Violette | 401/174 |
| 2,199,877 | A | | 5/1940 | Cervera | 132/311 |
| 2,299,564 | A | | 10/1942 | Castillo | 401/170 |
| 3,936,200 | A | | 2/1976 | O'Rourke | 401/184 |
| 3,937,371 | A | | 2/1976 | Del Bon | 222/494 |
| 3,937,582 | A | | 2/1976 | Del Bon | 401/134 |
| 3,938,897 | A | | 2/1976 | Craig | 401/155 |
| 3,995,648 | A | | 12/1976 | Kuryla | 132/84 |
| 4,049,354 | A | | 9/1977 | O'Rourke | 401/134 |
| 4,062,635 | A | | 12/1977 | Teh-Sheng | 401/175 |
| 4,068,974 | A | | 1/1978 | Meyer et al. | 401/150 |
| 4,071,300 | A | | 1/1978 | Nichols et al. | 401/175 |
| 4,084,280 | A | | 4/1978 | May | 15/22 |
| 4,088,412 | A | | 5/1978 | Del Bon | 401/151 |
| 4,116,570 | A | | 9/1978 | Parenti | 401/155 |
| 4,124,316 | A | | 11/1978 | O'Rourke | 401/184 |
| 4,128,349 | A | | 12/1978 | Del Bon | 401/151 |
| 4,149,552 | A | | 4/1979 | Stewmon | 132/84 |
| 4,155,663 | A | | 5/1979 | Cerquozzi | 401/135 |
| 4,201,490 | A | | 5/1980 | D'Angelo | 401/175 |
| 4,236,651 | A | | 12/1980 | Meyer et al. | 222/82 |

(Continued)

*Primary Examiner*—David J. Walczak
(74) *Attorney, Agent, or Firm*—Fish & Richardson P.C.; Kelly Kordzik

(57) ABSTRACT

A toothbrush assembly has two main sections, a toothbrush head that incorporates toothbrush bristles and toothpaste holder. The toothbrush head has a bristle end and a shaft with an enclosed channel connecting the bristle end to a threaded end. A flexible tube extends from an opening in the channel to near the top of bristles. The threaded end mates to the chamber. The chamber is coupled to a plunger assembly having a plunger head that seals against the sides of the chamber. The plunger head pulls a vacuum on the chamber when moved laterally in a first direction and pressurizes the chamber when moved laterally in a second direction. A toothpaste tube is threaded into the threaded end of the chamber and toothpaste is extracted from the toothpaste tube into the chamber or delivered from the chamber to the bristles. A universal adapter is used for non-compatible toothpaste tubes.

13 Claims, 15 Drawing Sheets

U.S. PATENT DOCUMENTS

D258,852 S 4/1981 Clark ..... D4/108
4,269,207 A 5/1981 Konrad et al. ..... 132/84
4,275,750 A 6/1981 Clark ..... 132/84
4,277,194 A 7/1981 Smith ..... 401/173
4,291,995 A 9/1981 Dikoff ..... 401/175
4,388,011 A 6/1983 Smith ..... 401/173
4,408,920 A 10/1983 Walther et al. ..... 401/176
4,421,433 A 12/1983 Villanueva ..... 401/175
4,467,822 A 8/1984 Blackwell ..... 401/175
4,530,369 A * 7/1985 Adams ..... 132/311
4,583,563 A 4/1986 Turner ..... 132/311
4,622,984 A 11/1986 Gaebel ..... 132/308
4,655,627 A 4/1987 Bradley ..... 401/171
D303,733 S 10/1989 Benichou ..... D4/108
4,875,791 A 10/1989 Hassan ..... 401/176
4,886,389 A 12/1989 Vidovic ..... 401/191
4,893,957 A 1/1990 Byriel ..... 401/146
4,957,125 A 9/1990 Yaneza ..... 132/309
4,961,717 A 10/1990 Hickey ..... 446/76
5,039,244 A 8/1991 Cheng ..... 401/176
5,062,728 A 11/1991 Kuo ..... 401/176
5,066,155 A 11/1991 English et al. ..... 401/175
5,148,567 A 9/1992 Daub ..... 15/22.1
5,158,383 A 10/1992 Glover et al. ..... 401/150
5,167,348 A 12/1992 Okami et al. ..... 222/103
D343,064 S 1/1994 Reno ..... D4/108
D347,944 S 6/1994 Honora ..... D4/108
5,321,866 A 6/1994 Klupt ..... 15/22.1
5,346,324 A 9/1994 Kuo ..... 401/146
D355,074 S 2/1995 Devecchio et al. ..... D4/108
5,403,105 A 4/1995 Jameson ..... 401/45
5,407,287 A 4/1995 Braun et al. ..... 401/176
5,439,014 A 8/1995 Moussa ..... 132/311
5,462,377 A 10/1995 Martinez, Jr. et al. ..... 401/185
D373,023 S 8/1996 Otero et al. ..... D4/108
D375,407 S 11/1996 Smith ..... D4/108
D378,957 S 4/1997 Turner et al. ..... D4/108
5,636,933 A 6/1997 Vizsolyi ..... 401/269
D382,712 S 8/1997 Wicks ..... D4/108
5,746,532 A 5/1998 Megill et al. ..... 401/175
D395,167 S 6/1998 Yousefian ..... D4/108
5,908,257 A 6/1999 Martin ..... 401/271
5,909,977 A 6/1999 Kuo ..... 401/146
5,911,532 A 6/1999 Evancic ..... 401/191
5,918,996 A 7/1999 Coolbaugh ..... 401/175
D413,204 S 8/1999 Mitchell ..... D4/108
5,988,442 A 11/1999 Corey et al. ..... 222/78
6,000,410 A 12/1999 Tortorice ..... 132/308
6,009,886 A * 1/2000 Labranche et al. ..... 132/309
D421,679 S 3/2000 Armstrong ..... D4/108
6,039,489 A 3/2000 Harman et al. ..... 401/146
6,056,466 A 5/2000 Johnson et al. ..... 401/188 R
6,076,223 A 6/2000 Dair et al. ..... 15/167.1
6,095,710 A 8/2000 Ayeni ..... 401/270
6,142,694 A 11/2000 Rivlin et al. ..... 401/181
6,179,503 B1 1/2001 Taghavi-Khanghah ..... 401/184
D439,413 S 3/2001 Klein ..... D4/108
6,206,600 B1 3/2001 Rosenberg et al. ..... 401/272
6,213,663 B1 4/2001 Micaletti et al. ..... 401/176
6,238,118 B1 5/2001 Tryon ..... 401/153
6,241,412 B1 6/2001 Spies et al. ..... 401/129
6,257,791 B1 7/2001 Scamard ..... 401/286
6,273,629 B1 8/2001 Jordan ..... 401/286
D448,933 S 10/2001 Mitchell et al. ..... D4/108
D449,448 S 10/2001 Ekeoba ..... D4/108
6,321,944 B1 11/2001 Cetrangolo ..... 222/105
6,325,076 B1 12/2001 Ramirez ..... 132/309
6,332,233 B1 12/2001 Proulx ..... 15/167.1
6,334,451 B1 1/2002 Yang ..... 132/311
6,345,629 B1 2/2002 Vives ..... 132/308
6,386,783 B1 5/2002 Spoelman ..... 401/270
6,402,410 B1 6/2002 Hall et al. ..... 401/146
D459,585 S 7/2002 Moreno et al. ..... D4/108
6,481,910 B1 11/2002 Yang ..... 401/175
6,536,979 B1 3/2003 Kenny et al. ..... 401/270
6,752,558 B1 * 6/2004 Hsu ..... 401/270

* cited by examiner

TRAVEL TOOTHBRUSH ASSEMBLY

CROSS REFERENCE TO RELATED APPLICATION

This Application claims priority under 35 U.S.C. §119(e) to U.S. Provisional Application No. 60/320,224, filed May 27, 2003, which is hereby incorporated herein by reference in its entirety.

TECHNICAL FIELD

This invention relates to toothbrushes with paste dispensing and in particular to travel toothbrushes that are sealed and provide toothpaste dispensing through the toothbrush bristles and provide for easy loading of toothbrush with toothpaste directly from a toothpaste tube. This invention relates to travel-ready toothbrushes. More specifically, this invention is an assembly used to construct self-dispensing, leakage-free, refillable toothbrushes with replaceable bristles. The assembly described in this invention is incorporated into various toothbrush designs. Toothbrushes that use this assembly can then be styled to emulate a variety of common and stylized objects such as a pen, a cigar, a make-up applicator, or other cylindrical objects.

BACKGROUND INFORMATION

Toothbrushes with self-dispensing toothpaste chambers have been suggested that combine the toothbrush and toothpaste container into one object. This eliminates the need for the user to carry both a toothbrush and toothpaste container and enables the user to conveniently brush wherever a water supply is available. Previous designs, however, do not lend themselves to versatility whereby a variety of different styled toothbrushes can be constructed using interchangeable parts. Patents that describe travel-ready, self-dispensing toothbrushes as finished products are not intended to be used as subassemblies or components. Therefore, the nature of those designs differs from this patent, which is used as a building block for constructing various finished toothbrush designs.

Several patents relating to travel-ready, self-dispensing toothbrushes are described below. One of the most popular travel ready, self-dispensing toothbrush is described in U.S. Re. Pat. No. 6,142,694. The invention describes a finished toothbrush and not a subassembly. In addition, the functionality of this toothbrush has several drawbacks. First is the fact that the toothbrush is disposable and not refillable. The user is not able to choose the brand of toothpaste used. In addition, the disposable nature necessitates the use of lower quality, low usage bristles. Another drawback is that this toothbrush is prone to water leakage and does not lend itself to being carried in the pocket of an expensive garment, handbag, or computer case without a watertight container. Another drawback is that that toothbrush is not appealing to the discretionary user.

There are two fundamental problems with prior art designs. First the dispensing portion of the toothbrush assembly is not designed to be disassembled. Toothpaste is a material that has different qualities and with time may tend to clog or get too rigid to be properly dispensed. A workable dispensing toothbrush assembly needs to be designed so that it can be disassembled for cleaning. Secondly, the chamber that holds the toothpaste also holds the elements that are used to facilitate loading toothpaste into the chamber and dispensing toothpaste from the chamber. Prior art designs did not isolate the toothpaste holding chamber from the elements that dispensed the toothpaste. For example, most designs have a threaded shaft that extends into the toothpaste and also engages threads in the element used to push toothpaste from the chamber. This threaded shaft may get contaminated with material that gets transferred to the toothpaste.

There is, therefore, a need for a toothbrush assembly comprising a threaded toothbrush head section, a delivery tube integral to the threaded toothbrush head section for delivering toothpaste to the top of the toothbrush bristles, and a chamber section operable for storing toothpaste and selectively receiving toothpaste from a toothpaste tube and delivering the toothpaste to the toothbrush bristles or back to the toothpaste tube. The toothbrush assembly needs to be made of component parts such that the chamber section can be disassembled for cleaning.

SUMMARY OF THE INVENTION

A toothbrush assembly is made with three main elements, a toothbrush head section that incorporates toothbrush bristles, a toothpaste holder section, and a leak proof cap. The toothbrush head section has bristles on a bristle end and a shaft connecting the bristle end to a threaded end. The shaft has an encased channel extending from the threaded end to substantially the center of the bristles on the bristle end. A flexible tube extends from an opening in the channel to substantially the top of the bristles. The flexible tube is sufficiently flexible that it does not interfere with the action of the bristles when brushing teeth. The threaded end toothbrush head has male threads for mating to female threads in a threaded opening in a chamber in the toothpaste holder section. The chamber also has a plunger end opening for receiving a plunger assembly having a plunger head that seals against the sides of the chamber.

The plunger assembly is made of component parts including a plunger head, a plunger body and a twist knob coupled to a threaded shaft. The plunger head is cylindrical with compliant seal features around its circumference that fits against and seals to the inside of the chamber. The plunger head is coupled to and retained by features on the plunger end of the plunger body. The plunger body has a non-cylindrical threaded shaft that has opposing threaded sections along its length. The threaded sections are on circumferential sections of the threaded shaft and allow a nut to be threaded and supported. The threaded shaft of the plunger body is non-cylindrical with surfaces and features that allow it to translate but not rotate relative to the twist knob to which it is coupled. The nut is threaded onto the threaded shaft until it is stopped by a flange on the plunger end. The twist knob has a cavity with inside surfaces and features that mate to the threaded shaft. The shaft of the plunger body and its engagement with mating features in the cavity of the twist knob allow the plunger body to smoothly translate within the cavity. When the plunger body is inserted into the chamber, the nut is stopped by a flange in the inside of the chamber. Features on the twist knob coupled to mating features on the inside of the chamber thereby retaining the plunger assembly while allowing the twist knob to rotate with respect to the chamber. When the twist knob is rotated, the plunger body is likewise rotated. Since the nut is stopped by a flange on the inside of the chamber, the force of the threads cause the shaft of the plunger body to translate with respect to the nut and thus into the chamber. The sealed plunger head is the only moving part that is exposed to the inside of the chamber.

The twist knob is coupled to a threaded shaft such that rotating the twist knob in a first rotary direction operates to laterally move the plunger head toward the threaded opening and in a second rotary direction operates to laterally move the plunger towards the plunger opening. Moving the plunger head, sealed against the sides of the chamber, operates to pull a vacuum on the chamber when moved in the first direction and to pressurize the chamber when moved in the second direction. A standard off-the-shelf toothpaste tube may be threaded into the threaded end of the chamber and toothpaste may be extracted from the toothpaste tube into the chamber or delivered from the chamber back into the toothpaste tube. After the chamber has been loaded with toothpaste and a toothbrush head section has been threaded into the threaded end, the twist knob delivers toothpaste from the chamber to the top of the toothbrush bristles when rotated in the second rotary direction. The outside surface of the chamber has features that retain the cap that fits over the toothbrush head section and prevents leakage of any water or toothpaste remaining in the bristles after use. A universal adapter has threads matching the threaded end and a compliant opening for mating to a variety of off-the-shelf toothpaste tubes.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1B:
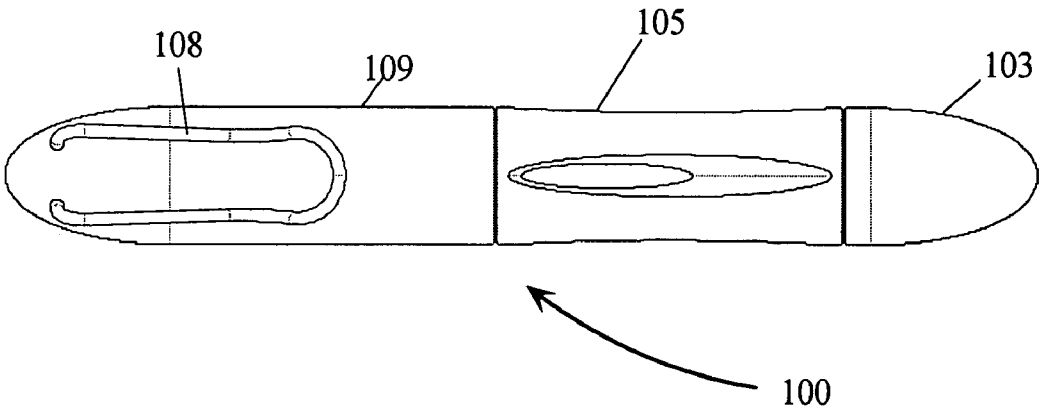
FIG. 1B is a view of the toothbrush assembly with the cap attached.

In the following description, numerous specific details are set forth to provide a thorough understanding of the present invention. However, it will be obvious to those skilled in the art that the present invention may be practiced without such specific details. In other instances, well-known devices may be shown in block diagram form in order not to obscure the present invention in unnecessary detail. For the most part, details concerning materials and processes and the like have been omitted inasmuch as such details are not necessary to obtain a complete understanding of the present invention and are within the skills of persons of ordinary skill in the relevant art.

The modular and interchangeable design of the toothpaste holder section, plunger assembly, and toothbrush head section enables toothpaste dispensing toothbrushes to be inexpensively manufactured in a variety of styles and colors using distinctive handles and protective caps. The plunger assembly offers a mechanism for finely controlling the flow of toothpaste. The replaceable toothbrush head section enhances the reusability and longevity of the toothbrush. A chamber in the toothpaste holder section that holds the toothpaste is isolated from moving parts in the plunger assembly reduces the chance of clogging, contamination of the toothpaste, and toothpaste leakage. The plunger assembly may be easily removed from the chamber and disassembled for cleaning.

Refer now to the drawings wherein depicted elements are not necessarily shown to scale and wherein like or similar elements are designated by the same reference numeral through the several views.

Figure 1A:
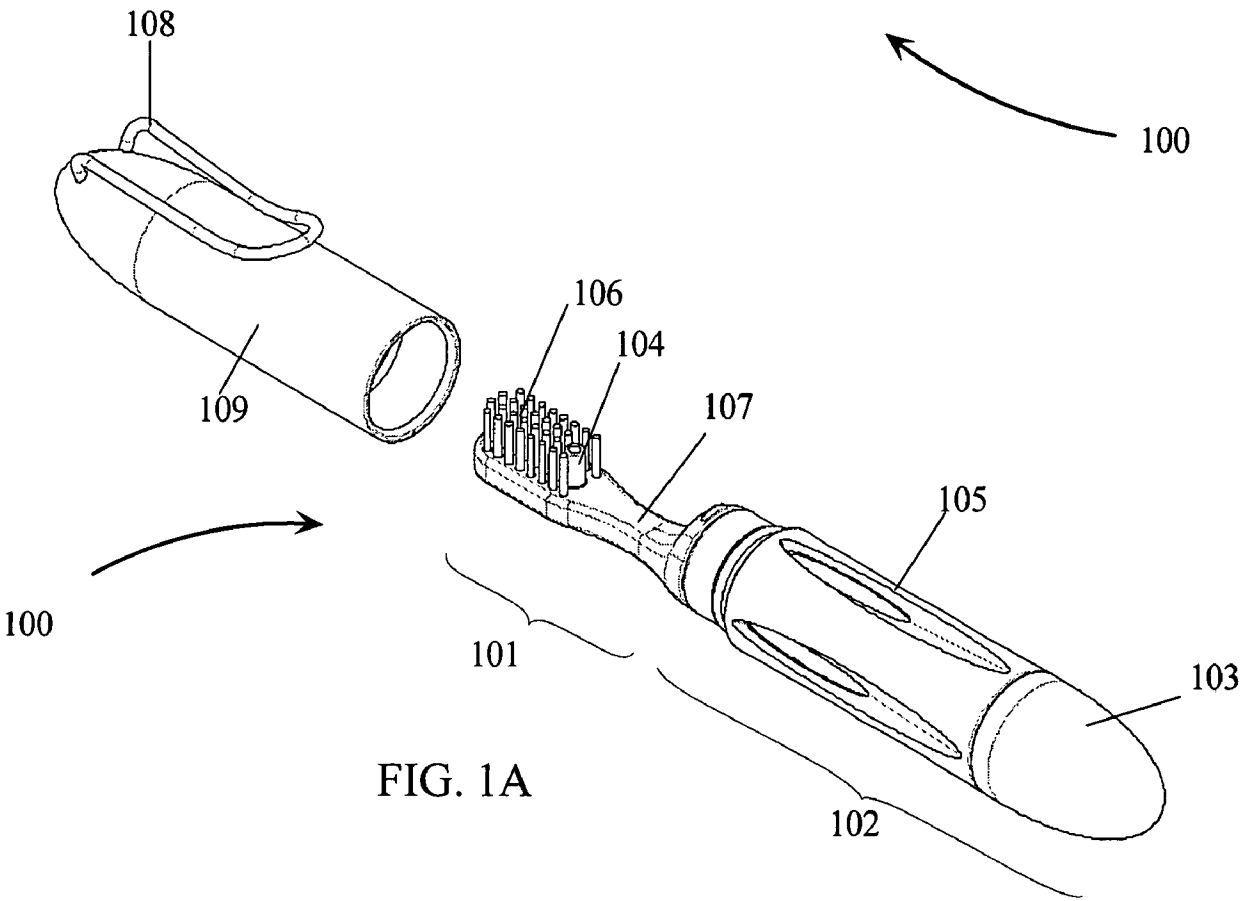
FIG. 1A is a view the toothbrush assembly according to embodiments of the present invention showing the toothbrush head section attached to the toothpaste holder section with the cap removed.

FIG. 1A is a view of the toothbrush assembly 100 according to embodiments of the present invention. Toothbrush assembly 100 comprises the cap 109 and two primary sections; toothbrush head section (toothbrush head) 101 and toothpaste holder section 102. Toothbrush head 101 comprises bristles 106 on the bristle end and a shaft 107 connecting the bristle end to the threaded end. The threads of the threaded end are not shown in this view. Shaft 107 has an encased channel (not shown) that extends from the bristle end to the threaded end. A flexible tube 104 is coupled to a brush opening (not shown) in the encased channel and extends to substantially the top of the bristles 106. In this way, toothpaste (not shown) may be deposited on the top of the bristles avoiding waste. Flexible tube 104 is sufficiently flexible such that it does not interfere with the action of the bristles 106 when brushing. Also shown in this view are a twist knob 103 which is coupled to a plunger head (not shown in this view) that operates inside toothpaste chamber 105 of toothpaste holder section 102. Cap 109 with clip 108 is also shown in this view.

FIG. 1B illustrates the toothbrush assembly 100 with cap 109 coupled to toothpaste holder section 102. The outside of toothpaste chamber 105 and twist knob 103 are shown in this view.

Figure 2:
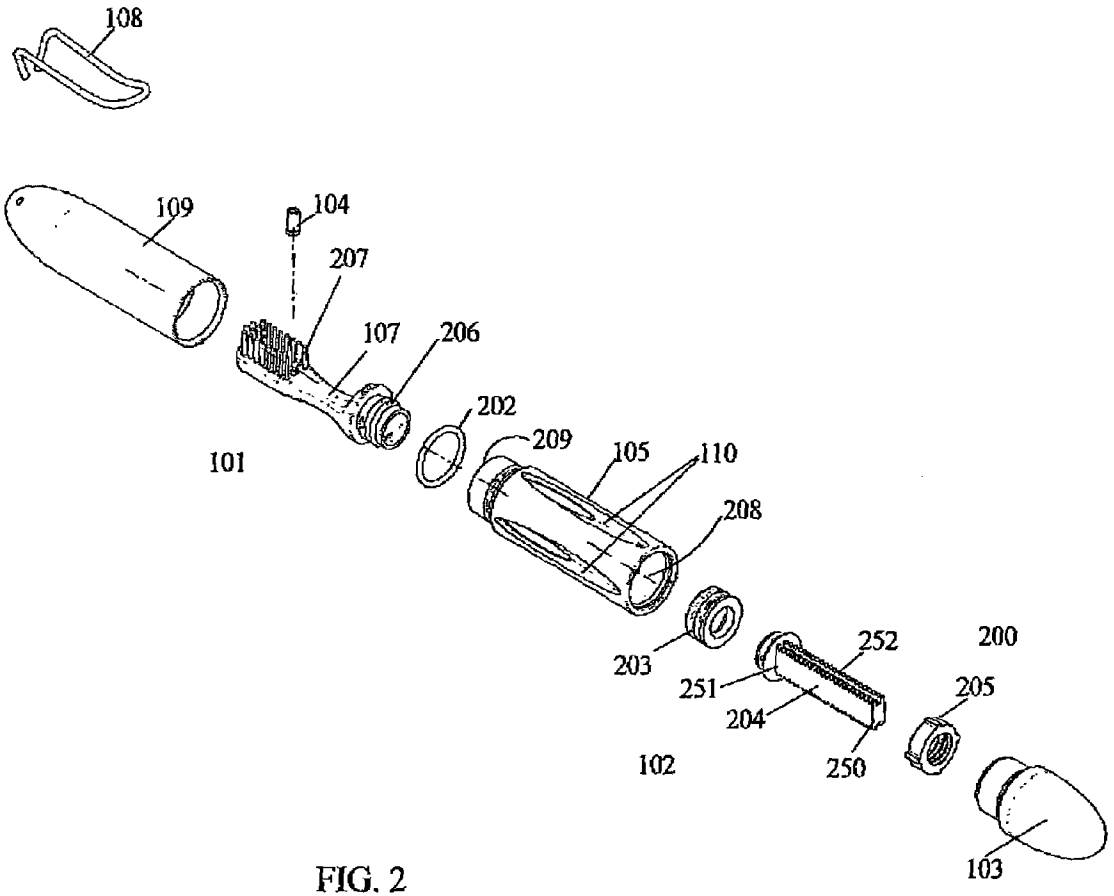
FIG. 2 is an exploded view of the toothbrush assembly according to embodiments of the present invention.

FIG. 2 is an exploded view of all the elements of toothbrush assembly 100. Plunger assembly 200 comprises a plunger head 203, plunger body 204, threaded nut 205 and twist knob 103. Plunger body 204 has plunger threads 252 from tail end 250 to head end 251. Nut 205 threads onto the plunger threads 252 from the tail end 250. Plunger assembly 200 is inserted into plunger end 208 of toothpaste chamber 105. O-ring 202 is coupled to a groove (not shown) on brush end 209 of toothpaste chamber 105. O-ring 202, toothpaste chamber 105 and plunger assembly 200 make up toothpaste holder section 102 of toothbrush assembly 100. Toothbrush head 101 comprises bristles 106 coupled to threaded end 206 with shaft 107. Flexible tube 104 couples to'brush opening 207 and extends substantially to the top of bristles 106.

Figure 3:
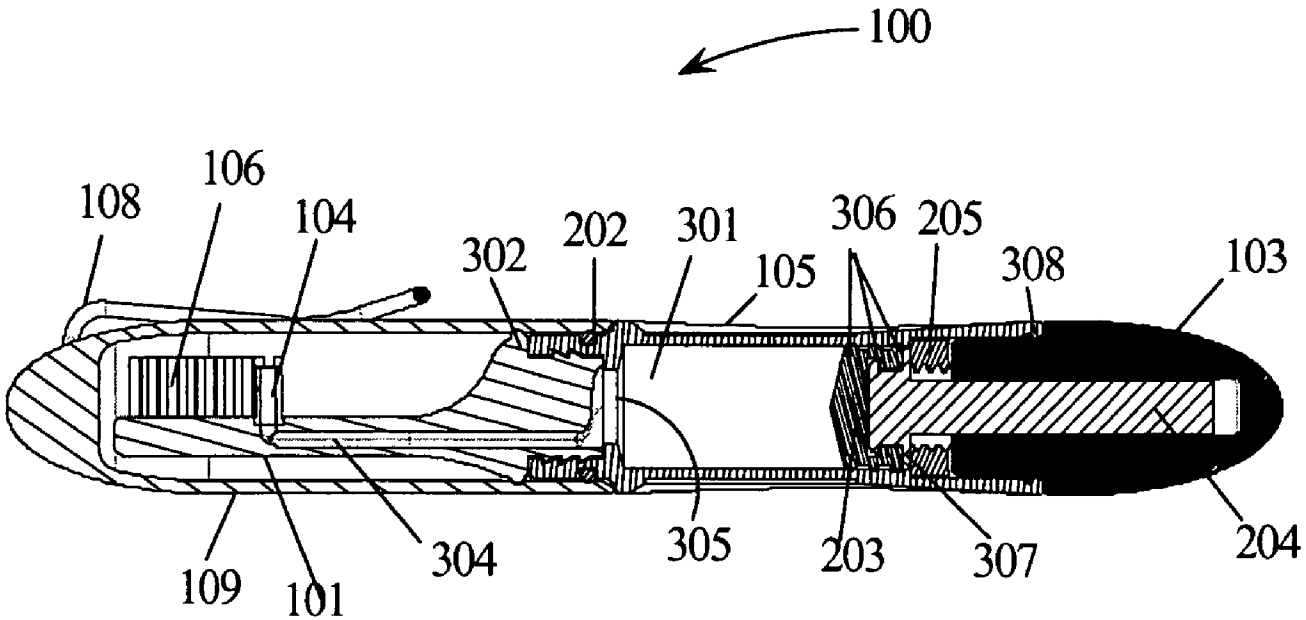
FIG. 3 is a section view of the toothbrush assembly of FIG. 2.
Figure 4A:
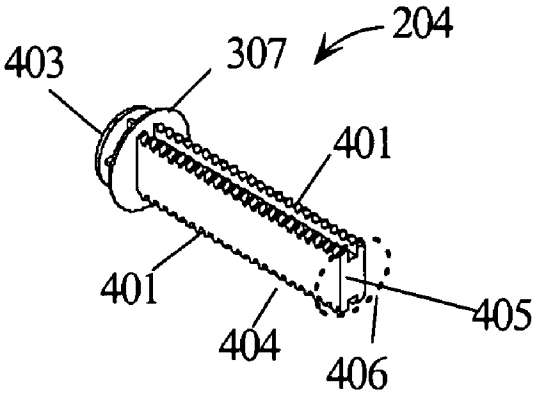
FIGS. 4A, 4B, 4C and 4D are various views of the plunger body of the plunger assembly used in the toothbrush assembly of FIG. 2.
Figure 4B:
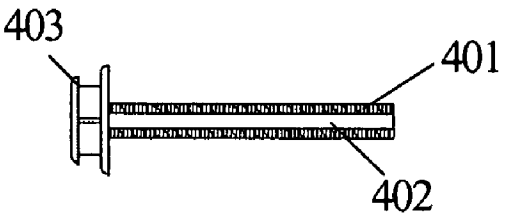
Figure 4D:
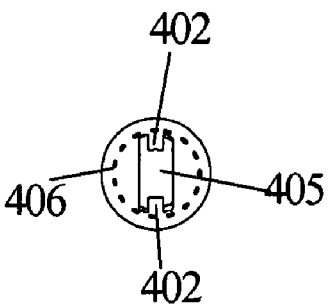
Figure 4C:
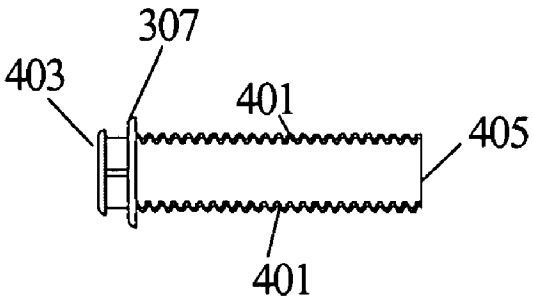

FIG. 3 is a section view of toothbrush assembly 100. Cap 109 with clip 108 extends over bristles 106 and shaft 107 and couples to features 302 on toothbrush head 101. Cap 109 seals against O-ring 202 to prevent leakage of any fluid left in bristles 106 after use. Opening 305 in brush end 209 accesses toothpaste chamber volume 301. Toothpaste (not shown) is disposed into toothpaste chamber volume 301. Plunger head 203 is the only moving part of toothbrush assembly 100 that comes in contact with toothpaste in toothpaste chamber volume 301. Seal features 306 extend around plunger head 203 and seal against the inside wall of toothpaste chamber 105. Plunger head 203 is coupled to an retained by features on plunger body 204. Nut 205 is threaded onto threads of plunger body 204 and is stopped by flange 307. A front surface of nut 205 also seats against an inside lip on toothpaste chamber 105. Plunger body 204 extends inside a recess of twist knob 103. Features 308 on twist knob 103 couple to mating features in plunger end 208 of toothpaste chamber 105. Twist knob 103 is free to rotate relative to toothpaste chamber 105 while coupled to plunger end 208. When twist knob 103 is over plunger body 204 and coupled to features 308 on toothpaste chamber 105, it contacts and retains nut 205 from any lateral motion. The plunger head 203 is coupled to plunger body 204 and therefore rotates when twist knob 103 rotates plunger body 204. Plunger head 203 moves laterally between plunger end 208 and toothbrush end 209 of toothpaste chamber 105 by the action of nut 205 and threads on plunger body 204 when twist knob 103 is rotated. Features of twist knob 103 (not shown) prevent plunger body 204 from rotating with respect to twist knob 103. Channel 304 is used to transport toothpaste from chamber volume 301 to bristle 106.

FIGS. 4A, 4B, 4C and 4D illustrate details of plunger body 204. Plunger body 204 does not have a cylindrical cross section The embodiment of FIG. 4 illustrates plunger body 204 with a rectangular cross section 405. Two sets of threads 401 are diametrically opposed on plunger body 204 and conform to a circumference 406 that is tangential to the cross section of plunger body 204. A mating recess to cross section 405 in twist knob 103 allows plunger body 204 to translate but not rotate within twist knob 103. Plunger head 203 fits over end 403 of plunger body 204. Flange 307 stops nut 205 when it is threaded on threads 401 of plunger body 204. Surfaces 404 (on each side of plunger body 204) serve to guide plunger body 204 when it moves laterally and aids in preventing binding.

Figure 5A:
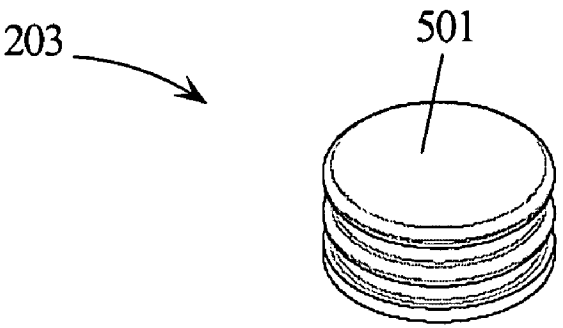
FIGS. 5A and 5B are various views of the plunger head of the plunger assembly used in the toothbrush assembly of FIG. 2.
Figure 5B:
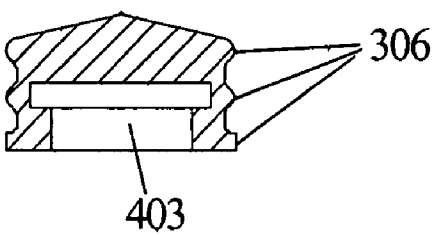

FIGS. 5A and 5B illustrate details of plunger head 203. Surface 501 of plunger head 203 is the only moving part that contacts toothpaste in toothpaste chamber volume 301. Seal features 306 act like three O-rings and seal against the inside wall of toothpaste chamber 105.

Figure 6A:
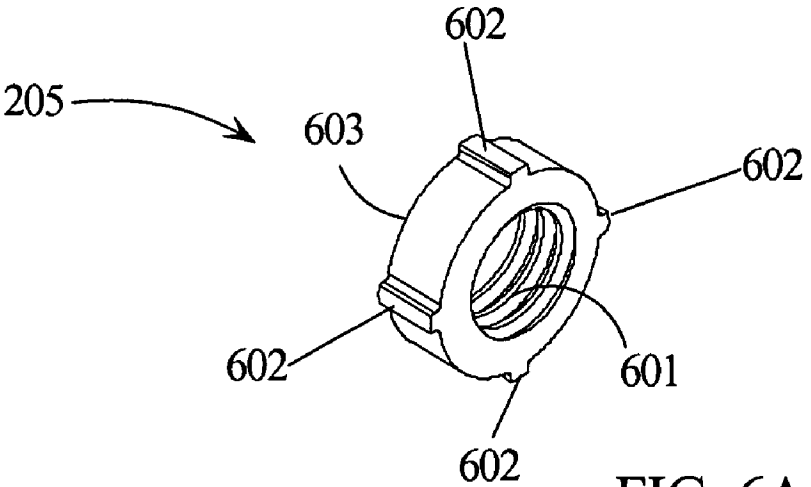
FIGS. 6A and 6B are various views of the nut of the plunger assembly used in the toothbrush assembly of FIG. 2.
Figure 6B:
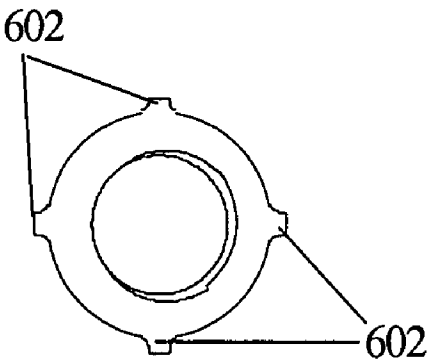

FIGS. 6A and 6B illustrate details of nut 205 of plunger assembly 200. Nut 205 has features 602 that fit into mating features on the inside wall of toothpaste chamber 105 and prevent nut 205 from rotating in toothpaste chamber 105 when plunger assembly 200 is inserted in and coupled to toothpaste chamber 105 with features 308. Surface 603 of nut 205 contacts flange 307 on plunger body 204. Threads 601 mate with threads 401 on plunger body 204.

Figure 7A:
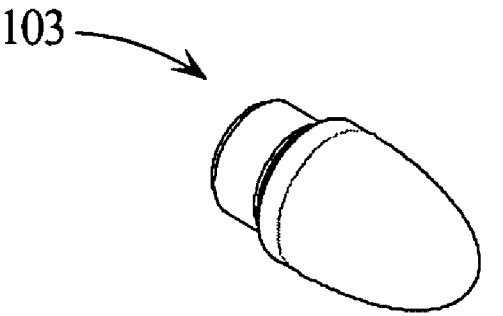
FIGS. 7A, 7B, 7C and 7D are various views of the twist knob of the plunger assembly used in the toothbrush and assembly of FIG. 2.
Figure 7B:
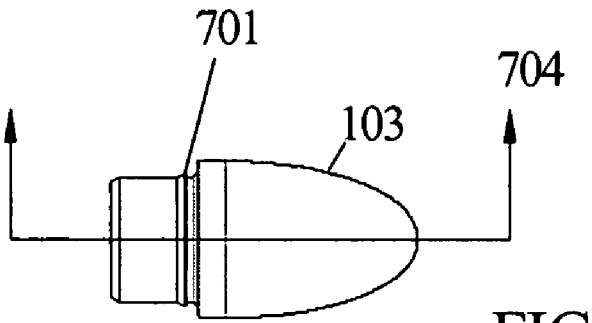
Figure 7C:
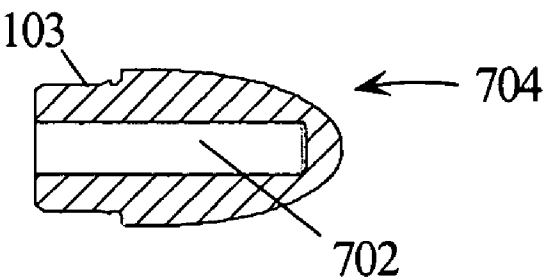
Figure 7D:
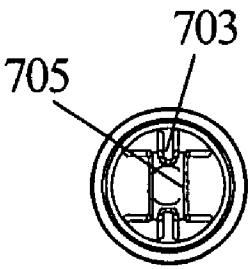

FIGS. 7A, 7B, and 7C illustrate details of twist knob 103 for toothbrush assembly 100. Recess 702 receives plunger body 204. Recess 702 has features 703 that mate with grooves 402 in plunger body 204 and aids guiding plunger body 204 in recess 702 when it moves laterally.

Figure 8A:
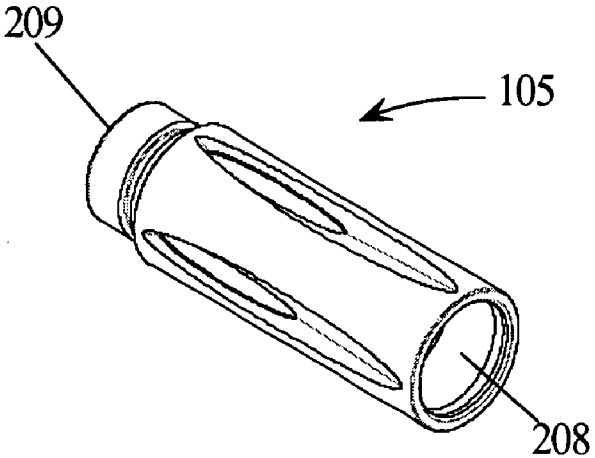
FIGS. 8A, 8B, and 8C are various views of the chamber of the toothpaste holding section of the toothbrush assembly of FIG. 2.
Figure 8B:
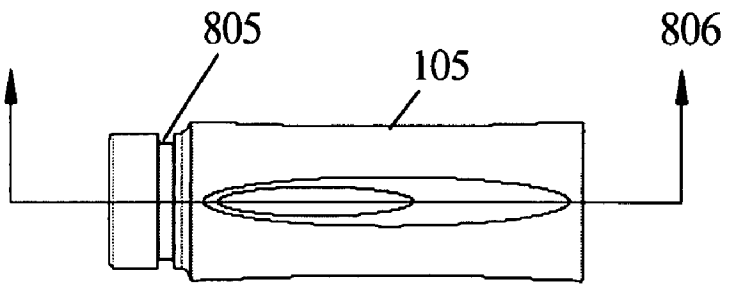
Figure 8C:
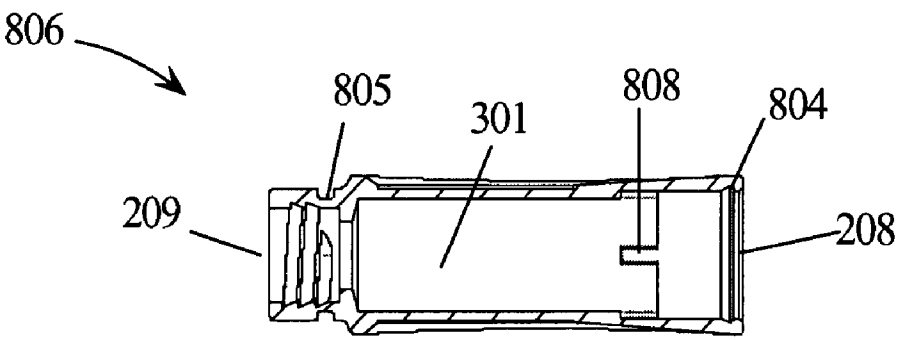

FIGS. 8A, 8B, and 8C illustrate details of toothpaste chamber 105. Toothpaste chamber 105 has brush end 801 and plunger end 208. Grooves 808 mate with corresponding features 602 on nut 205 preventing nut 205 from rotating within toothpaste chamber 105. Groove 805 holds and retains O-ring 202. Feature 804 in toothpaste chamber 105 mates with features 308 on twist knob 204. Toothpaste chamber volume 301 is modified by lateral motion of plunger head 203.

Figure 9A:
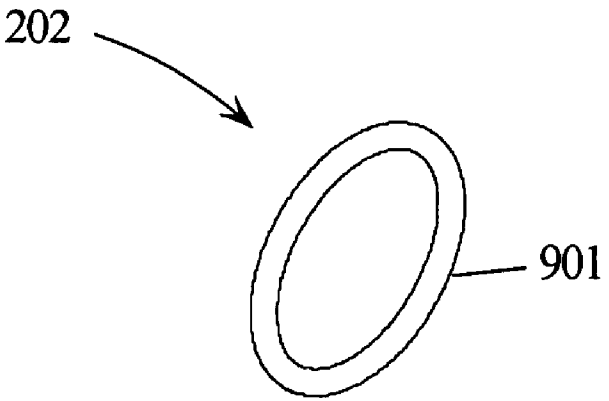
FIGS. 9A and 9B are views of the O-ring for sealing the cap of the toothbrush assembly of FIG. 2.
Figure 9B:
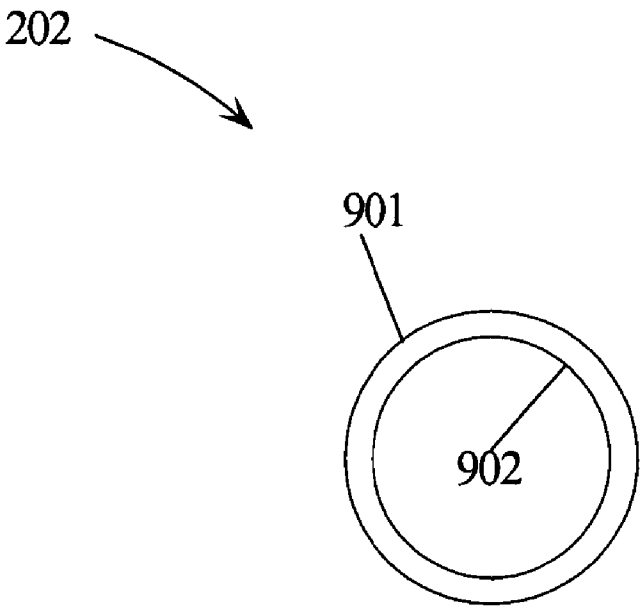

FIGS. 9A and 9B illustrate details of O-ring 202. O-ring 202 stretches and fits into groove 805 in toothpaste chamber 105. Inside 902 contacts the bottom of groove 805 and outside 901 contacts the inside wall of cap 109.

Figure 10A:
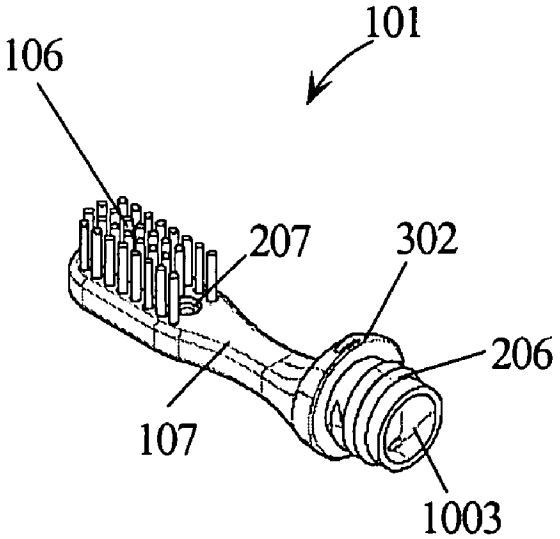
FIGS. 10A, 10B, and 10C are various views of the toothbrush head section of the toothbrush assembly of FIG. 2.
Figure 10B:
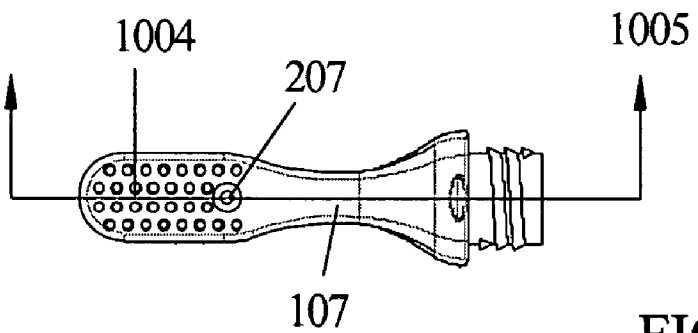
Figure 10C:
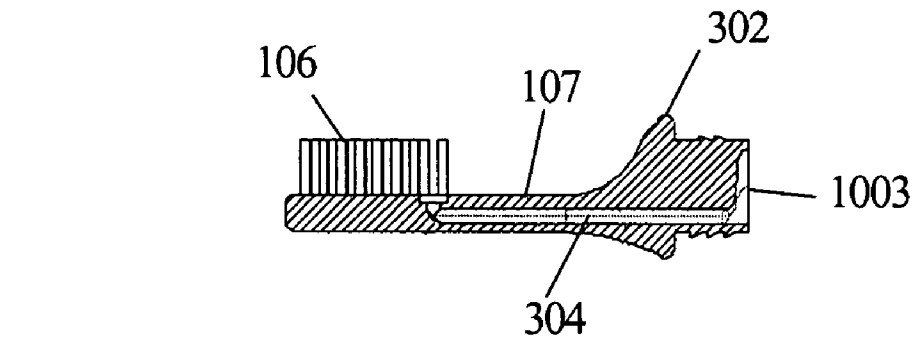

FIGS. 10A, 10B, and 10C illustrate details of toothbrush head 107. Holes 1004 are for receiving bristles 106. Opening 207 receives flexible tube 104. Encased channel 304 extends from opening 207 to opening 1003. Threads 206 mate with corresponding threads in toothpaste holder section 102. Threads 206 may be made compatible with one of the many off-the-shelf toothpaste tubes on the market.

Figure 11A:
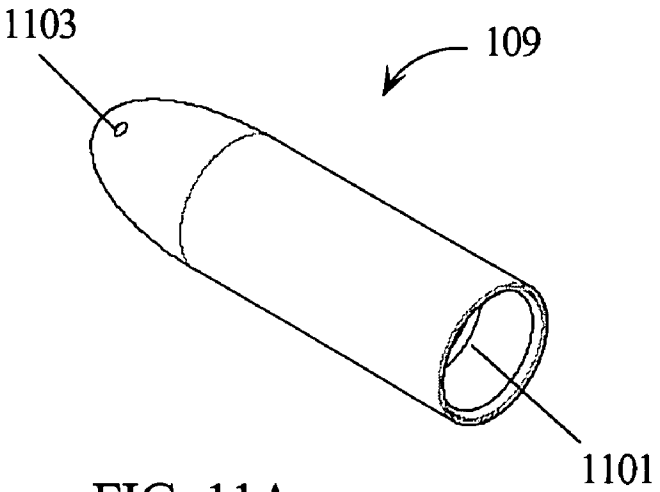
FIGS. 11A, 11B, and 11C are various views of the cap for the toothbrush assembly of FIG. 2.
Figure 11B:
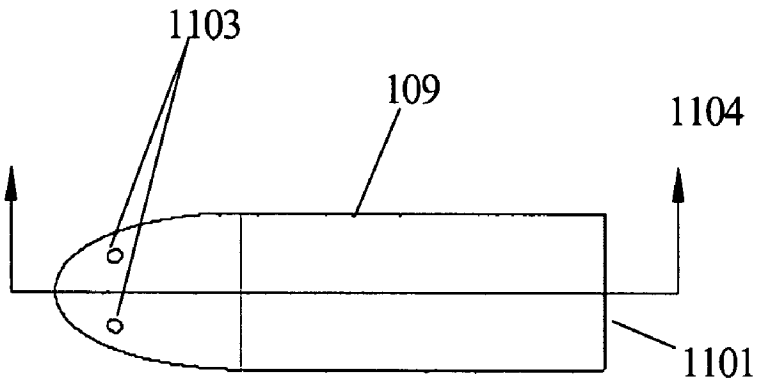
Figure 11C:
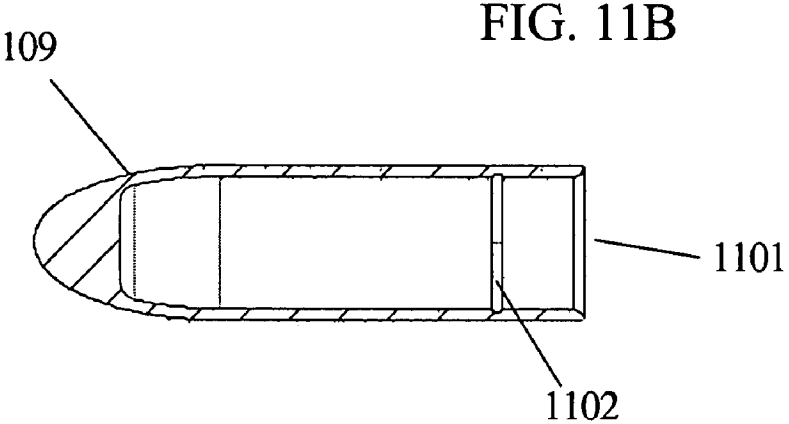

FIGS. 11A, 11B, and 11C illustrate details of cap 109 for toothbrush assembly 100. Cap 109 has holes 1103 for receiving mating features of clip 108. Feature 1202 is a groove for coupling to feature 302 on toothbrush head 101. Opening 1101 extends over toothbrush head 101.

Figure 12A:
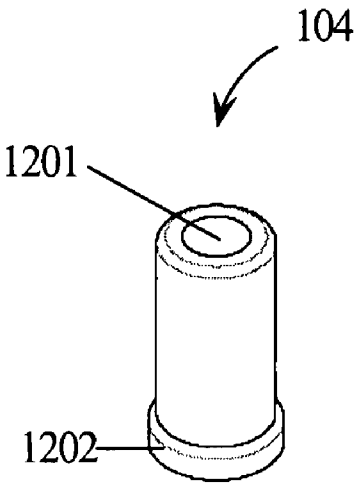
FIGS. 12A, 12B, and 12C are various views of the flexible tube of the toothbrush head section.
Figure 12B:
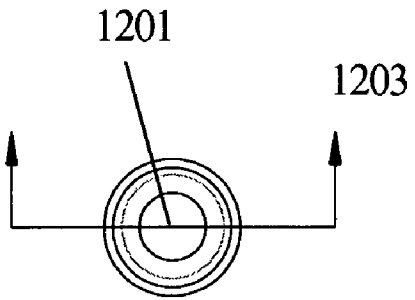
Figure 12C:
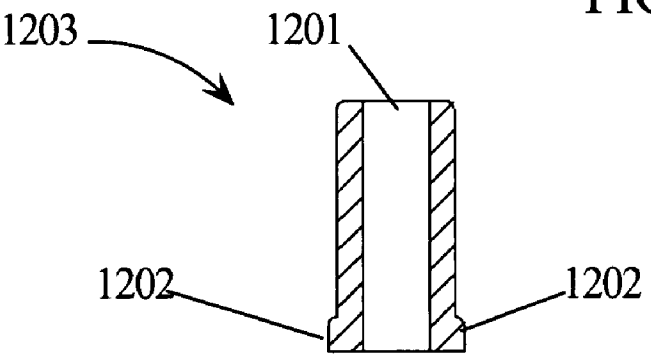

FIGS. 12A, 12B, and 12C illustrate details of flexible tube 104 that fits into opening 207 in toothbrush head 101. Flange 1202 fits into a mating groove retaining flexible tube 104 in toothbrush head 101 so that it is secure during brushing with bristles 106. Opening 1201 delivers toothpaste to substantially the top of bristles 106.

Figure 13:
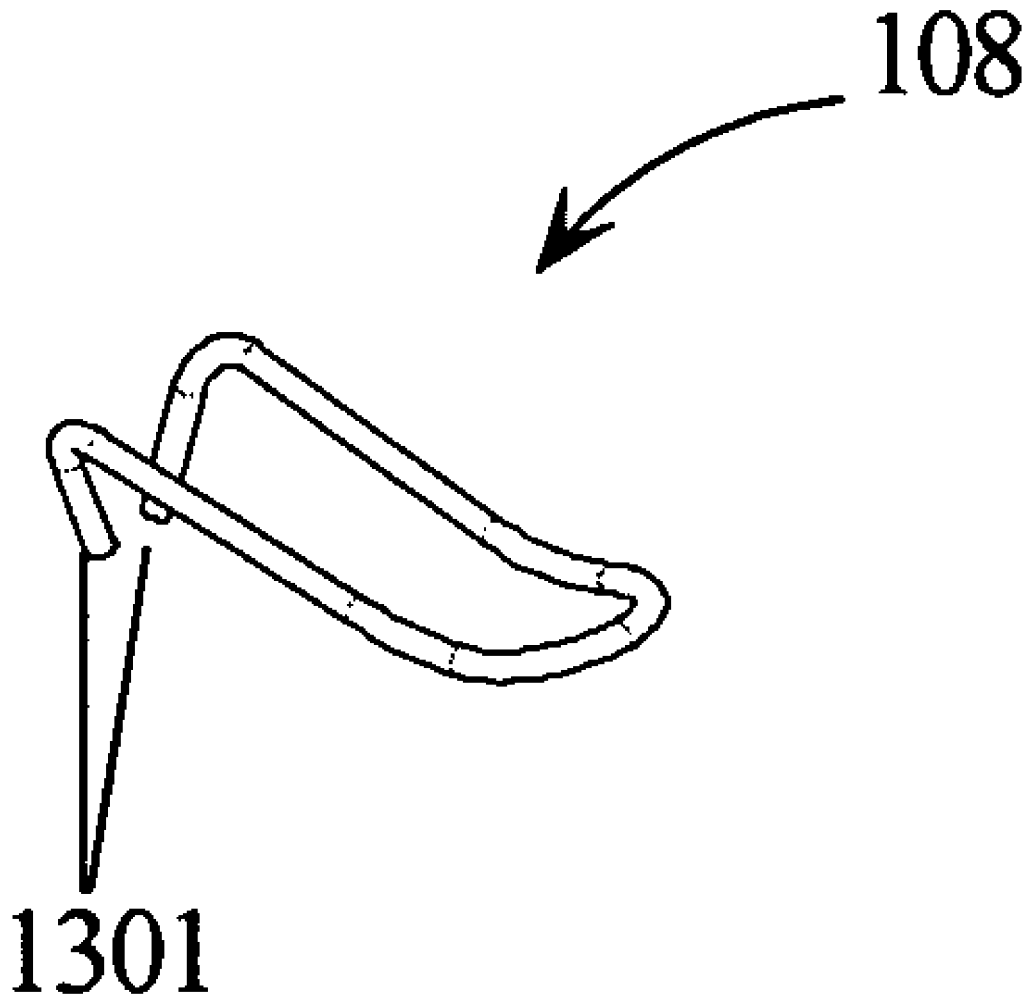
FIG. 13 is a clip used in the cap of the toothbrush assembly of FIG. 2.

FIG. 13 illustrates details of clip 108 for toothbrush assembly 100. Features 1301 couple and retain clip 108 to cap 109.

Figure 14A:
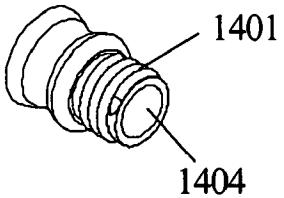
FIGS. 14A, 14B, and 14C are various views of the universal adapter used with embodiments of the present invention.

FIG. 14A illustrate details of a universal adapter 1400 used with embodiments of the present invention. Shown are opening 1404 for toothpaste flow and adapter threads 1401 for threading into toothpaste holder section 102.

Figure 14B:
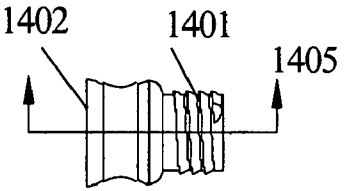

FIG. 14B is a side view of the universal adapter 1400 showing toothpaste tube end 1402 and adapter threads 1401 on toothbrush end for mating with section line 1405.

Figure 14C:
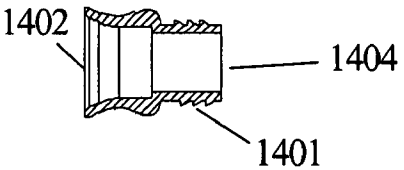

FIG. 14C illustrates a section view of a universal adapter 1400 used with embodiments of the present invention. Shown are a side view of opening 1404 for toothpaste flow, adapter threads 1401 for threading into toothpaste holder section 102, and toothpaste tube receiving end 1402.

Figure 14D:
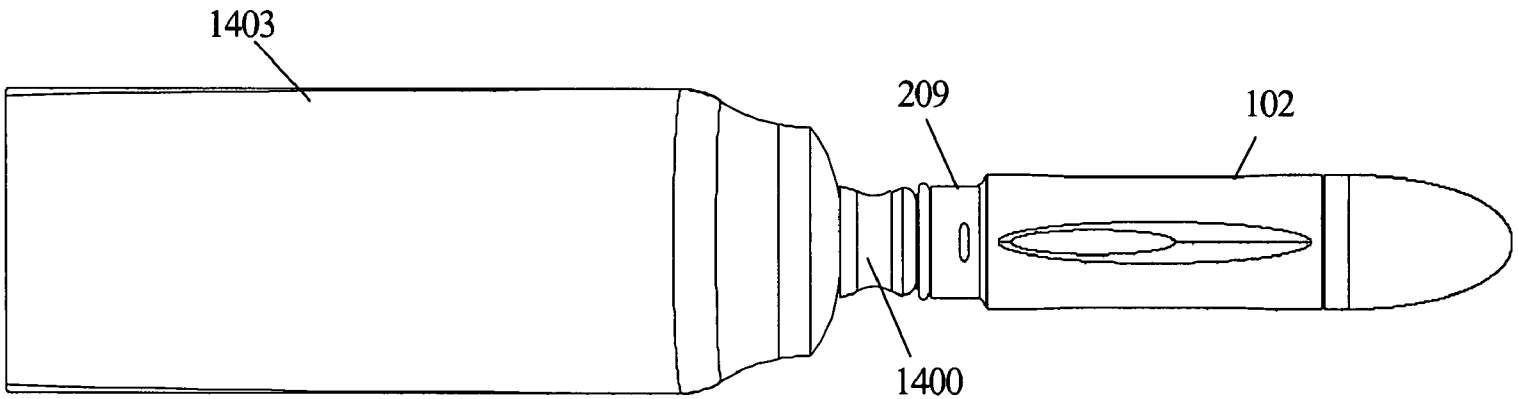
FIG. 14D illustrates a toothpaste tube coupled to the toothpaste holding section of the toothbrush assembly of FIG. 2 using the universal adapter illustrated in FIGS. 14A, 14B, and 14C.

FIG. 14D illustrates toothpaste tube 1403 coupled to the threaded end 209 of toothpaste chamber 105 with universal adapter 1400.

Figure 15A:
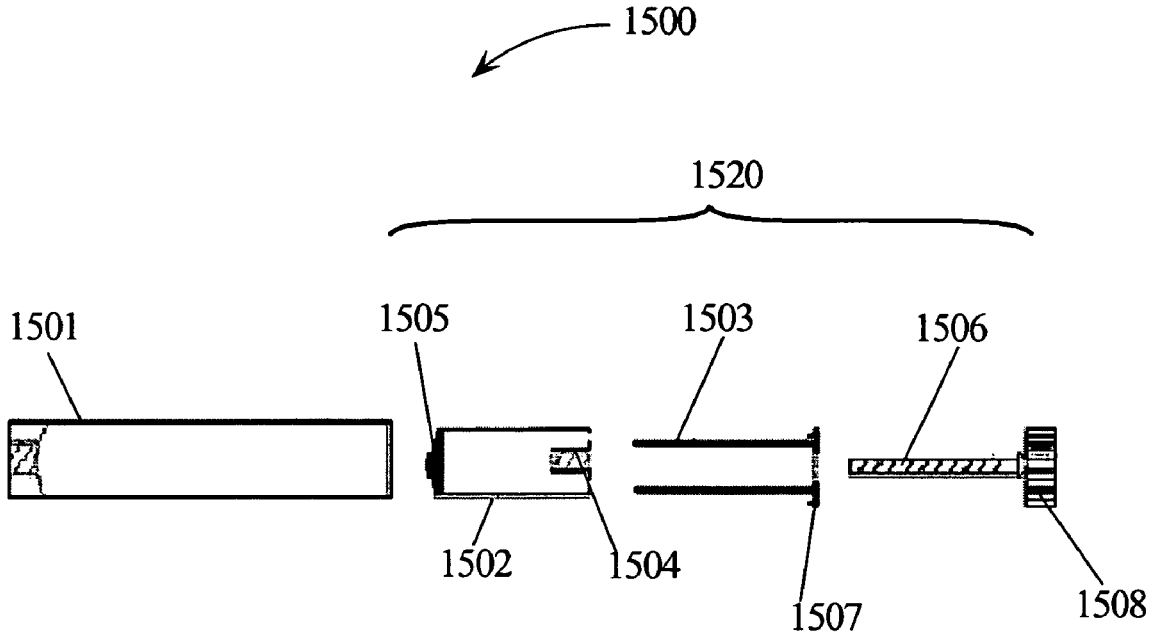
FIGS. 15A and 15B illustrate various views of another embodiment of the present invention.
Figure 15B:
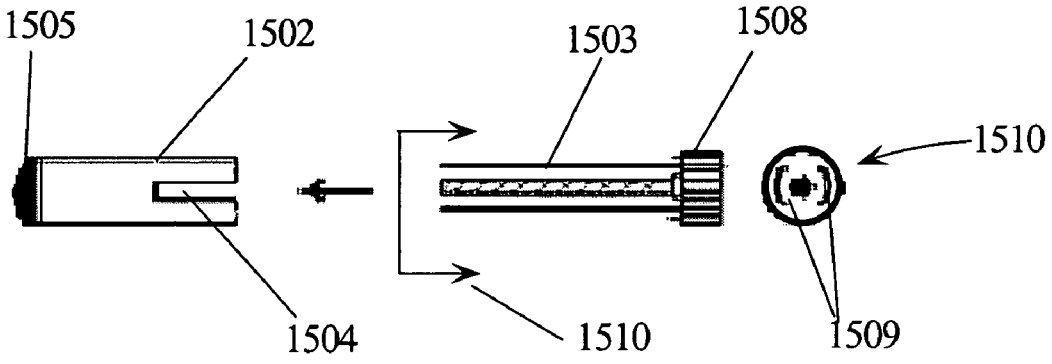

FIGS. 15A and 15B illustrate views of another embodiment of a toothpaste holding section 1500. FIG. 15A is an exploded view of toothpaste holding section 1500. Toothpaste holding section 1500 has a cylinder 1501 that receives plunger assembly 1520 also shown in an exploded view. Plunger assembly 1520 comprises plunger head 1502 with threaded section 1504, plunger sleeve 1503, and plunger shaft 1506 coupled to knob 1508. Threaded shaft 1506 mates with threaded section 1504. Plunger sleeve 1503 goes inside and couples to cylinder 1501 with flange 1507. Knob 1508 has features that snap over flange 1507 so that knob 1508 and sleeve 1503 are attached to cylinder 1501. While knob 1508 is firmly attached to cylinder 1501 it is free to rotate. When knob 1503 is rotated, the threads on shaft 1506 laterally move plunger head 1502. Plunger head 1502 has a compliant seal 1505 that circumferentially contacts against the walls of cylinder 1501. As plunger head 1502 is moved laterally by rotating knob 1503, it operates to pull a vacuum or to pressurize cylinder 1501.

FIG. 15B is a partial assembly view of plunger assembly 1520 coupled to knob 1508 and assembled into plunger sleeve 1503. View 1510 is an end view of this assembly showing the end profile of plunger sleeve 1503, shaft 1506, and twist knob 1508. Plunger sleeve 1503 fits into plunger head 1505 and the threads of shaft 1506 are threaded into threads 1504 forming plunger assembly 1520. Arms 1509 prevent sleeve 1503 from rotating with respect to chamber 1501.

Although the present invention and its advantages have been described in detail, it should be understood that various changes, substitutions and alterations can be made herein without departing from the spirit and scope of the invention as defined by the appended claims.

What is claimed is:

1. A toothbrush assembly comprising:

a toothbrush head having a bristle end coupled to a shaft, the shaft having an encased channel extending from the bristle end to a threaded end;

a toothpaste chamber having a brush end for receiving the threaded end of the toothbrush head and an open plunger end; and a removable plunger assembly coupled to the plunger end and having a plunger head extending into and sealing against an inside surface of the toothpaste chamber, the plunger head configured to impart both pressure and vacuum to a portion of the toothpaste chamber extending from the plunger head to the brush end, wherein only a surface of the plunger head is exposed to toothpaste in the toothpaste chamber as the plunger head rotates within the toothpaste chamber and moves laterally modifying a volume of the portion of the toothpaste chamber in response to rotating an exposed portion of the plunger assembly, and wherein the portion of the toothpaste chamber will fill by only coupling a toothpaste tube containing toothpaste to the brush end when the plunger head is moved a lateral distance towards the brush end reducing a volume of the portion of the toothpaste chamber and then moved laterally towards the plunger end expanding the volume of the portion of the toothpaste chamber to create a vacuum that extracts toothpaste from the toothpaste tube into the portion of the toothpaste chamber.

2. The toothbrush assembly of claim 1, wherein the brush end of the toothpaste chamber has a circumferential slot for receiving an O-ring and the toothbrush head has a first cap feature for engaging and retaining a cap placed over the toothbrush head.

3. The toothbrush assembly of claim 2, wherein the cap has a second cap feature for mating with the first cap feature and an inside surface of the cap seals against an O-ring disposed in the circumferential slot preventing liquid or toothpaste left in the bristles of the toothbrush head from leaking.

4. The toothbrush assembly of claim 1 further comprising an adapter having a toothpaste tube end for coupling to and sealing against the threads of a plurality of off-the-shelf toothpaste tubes and a toothbrush end with adapter threads for mating to the brush end of the toothpaste chamber.

5. The toothbrush assembly of claim 1 further comprising a flexible tube coupled to a bristle opening of the encased channel and extending to a point near a top of bristles in the bristle section.

6. The toothbrush assembly of claim 1, wherein the removable plunger assembly comprises a plunger having a head end coupled to the plunger head and a shaft section with a non-circular cross-section extending from the head end to a tail end, wherein the shaft section of the plunger body has plunger threads disposed on directly opposing surface areas corresponding to a circular circumference intersecting and tangential to the opposing surface areas.

7. The toothbrush assembly of claim 6 further comprising a nut threaded from the tail end onto the plunger threads of the shaft section of the plunger body to a stop corresponding to a flange on the head end, the nut engaging a stop surface on the flange determining how far the plunger assembly extends into the toothpaste chamber, wherein features of the nut engage features of the toothpaste chamber to prevent the nut from rotating relative to the toothpaste chamber.

8. The toothbrush assembly of claim 7 further comprising a twist knob corresponding to the exposed portion of the plunger assembly and having a recess receiving the tail end of the plunger and coupling to the shaft section for rotating the plunger body, wherein the twist knob has features for coupling the plunger assembly to the open plunger end when the plunger assembly is inserted into the open plunger end of the toothpaste chamber and wherein rotating the knob when the plunger assembly is sealed in the toothpaste chamber rotates the plunger head within the toothpaste chamber and moves the plunger head laterally within the toothpaste chamber, the plunger head operating to increase an available volume of the toothpaste chamber thus pulling a vacuum within the toothpaste chamber when moved towards the plunger end of the toothpaste chamber and operating to decrease the available volume in the toothpaste chamber thus pressurizing the toothpaste chamber when moved towards the brush end of the toothpaste chamber.

9. A toothbrush assembly comprising:

a toothbrush head having a bristle section coupled to a shaft, the shaft having an encased channel extending from the bristle section to a threaded end;

a toothpaste chamber having a brush end for receiving the threaded end of the toothbrush head and an open plunger end; and a removable plunger assembly coupled to the plunger end and having a plunger head extending into and sealing against an inside surface of the toothpaste chamber, the plunger head configured to impart both pressure and vacuum to a portion of the toothpaste chamber extending form the plunger head to the brush end, wherein the only moving part of the plunger assembly that is exposed to toothpaste in the toothpaste chamber is a surface of the plunger head as the plunger head moves laterally to modify a volume of the portion of the toothpaste chamber in response to rotating an exposed portion of the plunger assembly, and wherein the portion of the toothpaste chamber will fill by only coupling a toothpaste tube containing toothpaste to the brush end when the plunger head is moved a lateral distance towards the rush end reducing a volume of the portion of the toothpaste chamber and then moved laterally towards the plunger end expanding the volume of the portion of the toothpaste chamber to create a vacuum that extracts toothpaste from the toothpaste tube into the portion of the toothpaste chamber.

10. The toothbrush assembly of claim 9, wherein the brush end of the toothpaste chamber has a circumferential slot for receiving an O-ring and the toothpaste head has a first cap feature for engaging and retaining a cap placed over the toothbrush head.

11. The toothbrush assembly of claim 10, wherein the cap of a second cap feature for mating with the first cap feature and an inside surface of the cap seals against an O-ring disposed in the circumferential slot preventing liquid or toothpaste left in the bristles of the toothbrush head from leaking.

12. The toothbrush assembly of claim 9 further comprising an adapter having a toothpaste tube end for coupling to and sealing against the threads of a plurality of off-the-shelf toothpaste tubes and a toothbrush end with adapter threads for mating to brush end of the toothpaste chamber.

13. The toothbrush assembly of claim 9 further comprising a flexible tube coupled to a bristle opening of the encased channel and extending to a point near a top of bristles in the bristle section.

* * * * *